US011819085B1

(12) United States Patent
Cheney et al.

(10) Patent No.: US 11,819,085 B1
(45) Date of Patent: Nov. 21, 2023

(54) ADJUSTABLE FOOTWEAR HAVING APERTURES IN SOLE STRUCTURE

(71) Applicant: FAST IP, LLC, Vineyard, UT (US)

(72) Inventors: Craig Cheney, Lindon, UT (US); Seth Munger, Springville, UT (US); Alison Carlile, Vineyard, UT (US); Aislynn Edwards, Schenectady, NY (US); Joseph Eddington, American Fork, UT (US)

(73) Assignee: FAST IP, LLC, Lindon, UT (US)

( * ) Notice: Subject to any disclaimer, the term of this patent is extended or adjusted under 35 U.S.C. 154(b) by 0 days.

(21) Appl. No.: 17/143,854

(22) Filed: Jan. 7, 2021

Related U.S. Application Data

(60) Provisional application No. 62/957,817, filed on Jan. 7, 2020.

(51) Int. Cl.
*A43B 13/14* (2006.01)
*A43B 3/26* (2006.01)
*A43B 13/04* (2006.01)

(52) U.S. Cl.
CPC ..... *A43B 13/141* (2013.01); *A43B 3/26* (2013.01); *A43B 13/04* (2013.01)

(58) Field of Classification Search
CPC ..... A43B 13/141; A43B 13/14; A43B 3/26; A43B 13/16; A43B 11/00; A43B 3/24; A43B 5/1608; A43B 11/02
USPC ..... 36/97, 8.4, 25 R, 31, 102
See application file for complete search history.

(56) References Cited

U.S. PATENT DOCUMENTS

| | | | | |
|---|---|---|---|---|
| 1,830,648 | A | 11/1931 | Engel | |
| 2,112,052 | A | 3/1938 | Smith | |
| 2,776,499 | A | 1/1957 | Guintini | |
| 3,541,708 | A | 11/1970 | Rosen | |
| 4,083,128 | A | 4/1978 | Rossman | |
| 4,813,157 | A | 3/1989 | Boisvert et al. | |
| 4,968,492 | A | 11/1990 | Rosen | |
| 5,036,604 | A | 8/1991 | Rosen | |
| 5,203,096 | A | 4/1993 | Rosen | |
| 5,241,762 | A | 9/1993 | Rosen | |
| 5,768,803 | A | 6/1998 | Evy | |
| 5,813,146 | A | 9/1998 | Gutkowski et al. | |
| 6,000,147 | A | 12/1999 | Kellerman | |
| 6,138,385 | A * | 10/2000 | Jungkind | A43B 3/26 36/31 |
| 6,442,874 | B1 | 9/2002 | Long | |
| 6,450,510 | B1 | 9/2002 | Liu | |
| 6,920,707 | B1 | 7/2005 | Greene et al. | |
| 7,055,268 | B2 | 6/2006 | Ha | |
| 7,225,563 | B2 | 6/2007 | Chen et al. | |
| 7,392,604 | B2 | 7/2008 | Greene et al. | |

(Continued)

FOREIGN PATENT DOCUMENTS

| | | | |
|---|---|---|---|
| CN | 203969442 | U | 12/2014 |
| CN | 108851327 | A | 11/2018 |

(Continued)

*Primary Examiner* — Jameson D Collier

(57) ABSTRACT

Example embodiments of the present disclosure comprise adjustable footwear having apertures in sole structure. The one or more apertures extend all or partially between opposing bottom and top surfaces of the sole structure. The one or more apertures are generally configured to facilitate and accommodate adjustability of the sole structure (e.g., in length and/or width).

5 Claims, 9 Drawing Sheets

(56) References Cited

U.S. PATENT DOCUMENTS 7,610,696 B2 11/2009 Davis
7,634,861 B2 12/2009 Kilgore
7,917,981 B1 4/2011 Lakic
8,505,220 B2 * 8/2013 James ..... A43B 13/14 36/102
9,301,571 B2 4/2016 Langvin
9,491,983 B2 11/2016 Rushbrook
9,808,045 B2 11/2017 Carlson et al.
10,159,302 B2 12/2018 Carlson et al.
10,499,707 B2 12/2019 Hobson et al.
10,588,382 B2 3/2020 Rushbrook
10,602,797 B2 3/2020 Lintaman
10,645,990 B2 5/2020 Rushbrook
10,667,579 B2 6/2020 Elder et al.
10,736,379 B2 8/2020 Cook et al.
10,765,170 B2 9/2020 Langvin et al.
10,765,175 B2 9/2020 Panian et al.
10,779,607 B1 9/2020 Chandel
10,827,800 B2 11/2020 Tannuzzi
10,827,803 B2 11/2020 Bell et al.
11,033,072 B2 6/2021 Oda
11,044,962 B2 6/2021 Cheung
2002/0178614 A1 12/2002 Issler
2004/0107604 A1 * 6/2004 Ha ..... A43B 3/26 36/97
2004/0107605 A1 * 6/2004 Caeran ..... A43B 5/0435 36/97
2005/0060913 A1 3/2005 Chil et al.
2005/0115114 A1 * 6/2005 Miller ..... A43B 3/26 36/97
2006/0107552 A1 5/2006 Clark et al.
2006/0130371 A1 * 6/2006 Schneider ..... A43B 3/26 36/97
2006/0162191 A1 7/2006 Mason
2008/0127518 A1 6/2008 Byrne et al.
2008/0178493 A1 7/2008 Scofield
2008/0296871 A1 * 12/2008 Hsieh ..... A63C 1/26 280/607
2009/0172972 A1 7/2009 Rosen
2009/0307929 A1 * 12/2009 Tvoua ..... A43B 3/108 36/97
2010/0139122 A1 * 6/2010 Zanatta ..... A43B 3/26 36/97
2011/0185600 A1 8/2011 Malek
2013/0152426 A1 6/2013 Lederer
2013/0219744 A1 8/2013 Case et al.
2014/0041256 A1 * 2/2014 Espinola ..... A43B 3/26 36/97
2014/0123516 A1 5/2014 Cressman et al.
2014/0182167 A1 7/2014 James et al.
2014/0215770 A1 8/2014 Evesque et al.
2014/0237850 A1 8/2014 Hull
2014/0259752 A1 9/2014 Feldman
2015/0047222 A1 * 2/2015 Rushbrook ..... A43B 13/141 36/83
2015/0366288 A1 12/2015 Miller
2017/0055626 A1 * 3/2017 Rushbrook ..... A43C 1/003
2017/0056754 A1 3/2017 Yu et al.
2017/0188655 A1 7/2017 Carlson et al.
2017/0367439 A1 * 12/2017 Fallon ..... A43B 13/04
2018/0135213 A1 5/2018 Bell et al.
2018/0242694 A1 8/2018 Webster
2018/0255872 A1 9/2018 Manasiya
2018/0325216 A1 11/2018 Toronjo
2019/0297988 A1 10/2019 Oden et al.
2019/0380430 A1 12/2019 Seid
2020/0008516 A1 1/2020 Chan et al.
2020/0046080 A1 2/2020 Burns et al.
2020/0093220 A1 * 3/2020 Oda ..... A43B 3/24
2020/0253334 A1 8/2020 Elder et al.
2020/0352282 A1 11/2020 Drake
2020/0367604 A1 11/2020 Langvin et al.
2020/0375301 A1 12/2020 Cheung
2021/0037912 A1 2/2021 Spencer
2021/0204639 A1 7/2021 Yang
2021/0219651 A1 7/2021 Rushbrook et al.
2021/0227925 A1 7/2021 Kim

FOREIGN PATENT DOCUMENTS

CN 109549280 A 4/2019
DE 19851030 A1 * 5/2000
EP 1447018 A1 * 8/2004
GB 2432295 A 5/2007
JP 3014857 U * 8/1995
KR 20030004590 A * 1/2003
KR 20050097793 A 12/2005
WO WO-9517108 A1 * 6/1995
WO 2006106612 A2 10/2006

* cited by examiner

ADJUSTABLE FOOTWEAR HAVING APERTURES IN SOLE STRUCTURE

CROSS-REFERENCE TO RELATED APPLICATIONS

The present application claims priority to and the benefit of U.S. Provisional Application No. 62/957,817 filed Jan. 7, 2020, which is incorporated herein by reference in its entirety.

FIELD

The present disclosure relates to adjustable footwear having apertures in sole structure.

BACKGROUND

Whether due to growth, pregnancy, injury, swelling or activity (e.g., walking versus running), to name a few, the desired length and/or width of footwear may change over time, and do so before footwear is otherwise "worn out." The present disclosure addresses this need.

SUMMARY

Disclosed herein, in various embodiments, is a sole structure for adjustable footwear having at least one aperture. The at least one aperture may be configured to facilitate adjustability of at least one of a size and a shape of the sole structure.

Also disclosed herein, according to various embodiments, is a sole structure for adjustable footwear having a plurality of apertures and a locking feature. The plurality of apertures are configured to facilitate adjustability of at least one of a size and a shape of the sole structure, according to various embodiments. The locking feature may be generally disposed around at least a section of a perimeter of the sole structure, and the locking feature may be configured to compress and retain the plurality of apertures in an adjusted shape.

Also disclosed herein, according to various embodiments, is an adjustable footwear that includes a sole structure comprising a plurality of apertures. The plurality of apertures may be generally configured to facilitate adjustability of at least one of a size and a shape of the sole structure. The adjustable footwear may also include a footbed configured to engage with at least one aperture of the plurality of apertures. Engagement of the footbed with the sole structure is configured to at least one of adjust and retain the at least one aperture in an adjusted position.

BRIEF DESCRIPTION OF THE DRAWINGS

The accompanying drawings may provide a further understanding of example embodiments of the present disclosure and are incorporated in, and constitute a part of, this specification. In the accompanying drawings, only one shoe (either a left shoe or a right shoe) may be illustrated, however, it should be understood that in such instances, the illustrated shoe may be mirror-imaged so as to be the other shoe. The use of like reference numerals throughout the accompanying drawings is for convenience only, and should not be construed as implying that any of the illustrated embodiments are equivalent. The accompanying drawings are for purposes of illustration and not of limitation.

FIGS. 21 and 2J illustrate a side view of a sole structure of adjustable footwear having a pattern of apertures, in accordance with various embodiments;

DETAILED DESCRIPTION

Figure 1A:
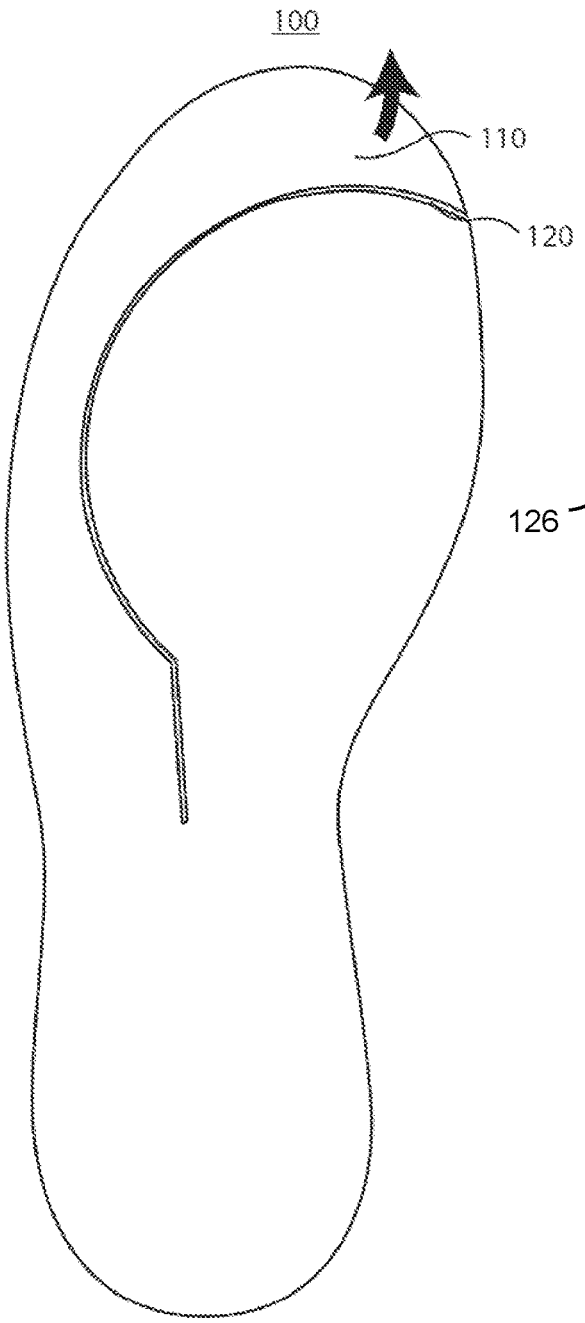
FIGS. 1A and 1B illustrate a sole structure for adjustable footwear having an arcing aperture, in accordance with various embodiments.

Example embodiments of the present disclosure are described in sufficient detail in this detailed description to enable persons having ordinary skill in the relevant art to practice the present disclosure, however, it should be understood that other embodiments may be realized and that mechanical and chemical changes may be made without departing from the spirit or scope of the present disclosure. Thus, this detailed description is for purposes of illustration and not of limitation.

For example, unless the context dictates otherwise, example embodiments described herein may be combined with other embodiments described herein. Similarly, references to "example embodiment," "example embodiments" and the like indicate that the embodiment(s) described may comprise a particular feature, structure, or characteristic, but every embodiment may not necessarily comprise the particular feature, structure, or characteristic. Moreover, such references may not necessarily refer to the same embodiment(s). Any reference to singular includes plural embodiments, and any reference to plural includes singular embodiments.

Any reference to coupled, connected, attached or the like may be temporary or permanent, removeable or not, non-integral or integral, partial or full, and may be facilitated by one or more of adhesives, stitches, hook and loop fasteners, buttons, clips, grommets, zippers and other means known in the art or hereinafter developed.

As used herein, the transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

No claim limitation is intended to invoke 35 U.S.C. 112(f) or pre-AIA 35 U.S.C. 112, sixth paragraph or the like unless it explicitly uses the term "means" and includes functional language.

In describing example embodiments of the adjustable footwear having apertures in sole structure, certain directional terms may be used. By way of example, terms such as "right," "left," "medial," "lateral," "front," "back," "forward," "backward," "rearward," "top," "bottom," "upper," "lower," "up," "down," and the like may be used to describe example embodiments of the adjustable footwear having apertures in sole structure. These terms should be given meaning according to the manner in which the adjustable footwear having apertures in sole structure is most typically designed for use, with the adjustable footwear having apertures in sole structure on a user's foot and with the user's shod foot disposed on or ready for placement on an underlying surface. Thus, these directions may be understood relative to the adjustable footwear having apertures in sole structure in such use. Similarly, as the adjustable footwear having apertures in sole structure is intended primarily for use as footwear, terms such as "inner," "inward," "outer," "outward," "innermost," "outermost," "inside," "outside," and the like should be understood in reference to the adjustable footwear having apertures in sole structure's intended use, such that inner, inward, innermost, inside, and the like signify relatively closer to the user's foot, and outer, outward, outermost, outside, and the like signify relatively farther from the user's foot when the adjustable footwear having apertures in sole structure is being used for its intended purpose. Notwithstanding the foregoing, if the foregoing definitional guidance is contradicted by an individual use herein of any of the foregoing terms, the term should be understood and read according to the definition that gives life and meaning to the particular instance of the term.

As used herein, a "footwear" refers to an athleisure shoe, a casual shoe, a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a flip flop, a boot, or other suitable type of shoe. Additionally, footwear can be sized and configured to be worn by men, women, or children.

In accordance with example embodiments, the present disclosure provides for an adjustable shoe comprising a sole structure and an upper, the sole structure having one or more apertures to provide for length and/or width adjustability of the shoe. The apertures can comprise slits, holes, perforations, cutouts, cutaways, weakened portions or the like. The apertures can extend to, and be open to, a perimeter of the sole structure. Alternatively, the apertures can be fully contained within the sole structure.

As used herein, "sole structure" refers to an outsole or portions thereof, a midsole or portions thereof, an insole or portions thereof, a wedge or portions thereof, or other suitable structure disposed between and/or adjacent to the foregoing parts of a shoe. A sole structure herein may comprise one or more of nylon, acetal homopolymer/polyoxymethylene, aluminum, graphite, thermoplastic polyurethane (TPU), thermoplastic copolyester elastomer (TPC-ET), polypropylene, acrylic resin, rubber, titanium, acrylonitrile butadiene styrene (ABS), and polycarbonate. Such a material may comprise a shape-memory material.

Generally disclosed herein, according to various embodiments, is a sole structure of a shoe that comprises one or more apertures extending all or partially between opposing bottom and top surfaces of the sole structure. The one or more apertures are generally configured to facilitate and accommodate adjustability of the sole structure (e.g., in length and/or width). That is, as described in greater detail below, the apertures may allow for adjustment in one or multiple directions in response to an action (e.g., a single action) taken by a user.

Figure 1B:
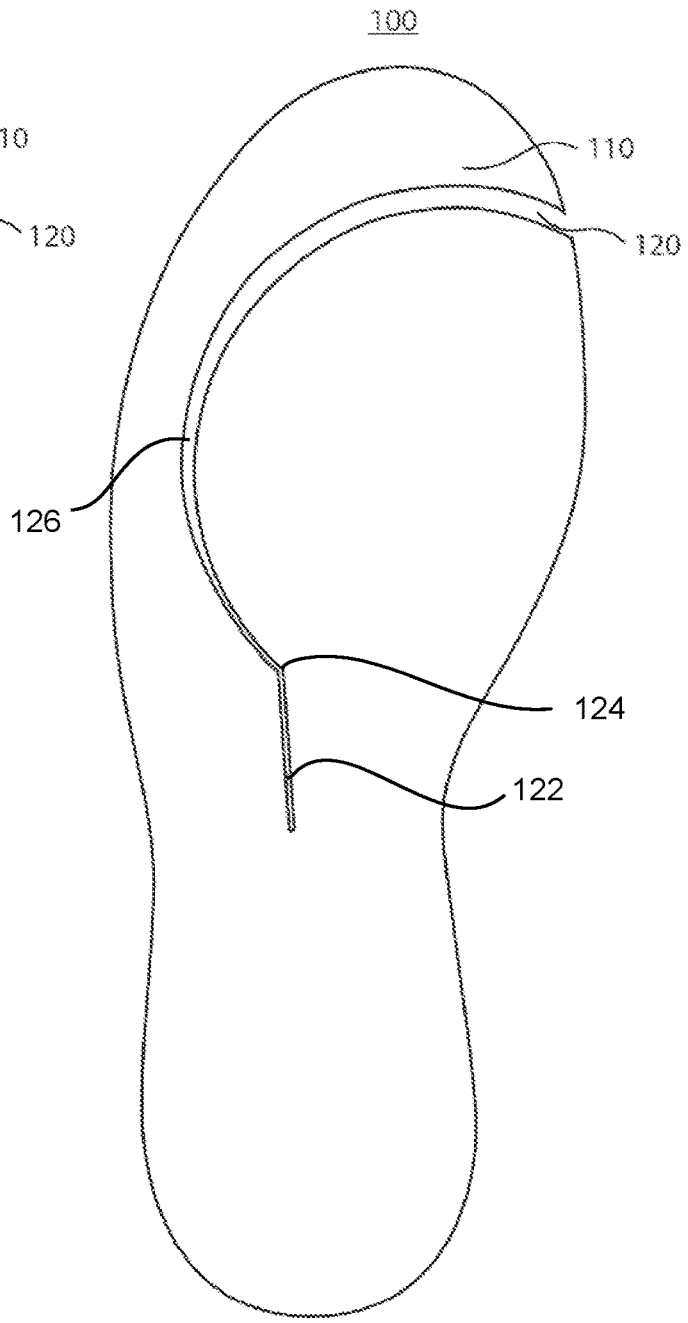

With reference to FIGS. 1A and 1B, the sole structure 110 of a shoe 100 may comprise a single aperture 120 extending all or partially between the bottom surface of the sole structure 110 and the top surface of the sole structure 110. For example, the aperture may extend completely through the sole structure 110, may extend only into one of the bottom and the top surface of the sole structure 110, or may extend into both of the bottom and the top surface of the sole structure 110 without passing entirely through to the opposing side (e.g., in an offset, complimentary fashion). The aperture 120 may extend along a length and/or width of the shoe, such that opening/closing of a single aperture can affect both length and width of the shoe. The aperture 120 can, for example, be in a J-hook shape or may have shape that resembles a scythe, and thus may comprise one or more bends or curves for transitioning the shape of the aperture. For example, the aperture may include a bend or curve extending into the forward portion to an edge of the sole structure 110, with a shank portion extending into the rearward portion of the sole structure 110. An end of the bend and/or the shank can comprise a pivot point. In example embodiments, the bend is open to a medial side of the shoe 100, while in other example embodiments, the bend is open to a lateral side of the shoe 100.

In various embodiments, the aperture comprises a scythe-shape having a substantially linear shank portion 122, a first bend 124 that directs the aperture toward one of the medial and lateral side of the sole structure, and then an arcing portion 126 that gradually bends the aperture back toward the other of the medial and lateral side of the sole structure. The arcing portion 126 may facilitate simultaneous length and width adjustments. Said differently, expansion of the dimensions of the arcing portion 126 may, for example, adjust both a length and a width of the sole structure 110. In various embodiments, the first bend 124 is a substantially abrupt bend between the shank portion 122 and the initial section of the arcing portion 126. In various embodiments, the angle of the first bend 124 is between about 90 degrees and about 170 degrees. In various embodiments, the angle of the first bend 124 is between about 135 degrees and about 160 degrees. As used in this context only, the term about means plus or minus 5% of the indicated value.

With reference to FIGS. 2A-2F, the sole structure 110 of a shoe 100 can comprise a plurality of apertures 120 extending all or partially between the bottom surface of the sole structure 110 and the top surface of the sole structure 110, the apertures 120 arranged in a pattern and variously extending along one or more lengths and/or widths of the shoe. The pattern can be auxetic, such that expansion of one of length and width expands the other. In example embodiments, the apertures 120 are concentrated in the forward portion of the shoe 100, while in other example embodiments, the apertures 120 are additionally or alternatively located in the rearward portion of the shoe 100. Apertures 120 can be held open with plugs inserted herein and/or held closed with clips between adjacent apertures 120. One or more of the ends of the apertures 120 can comprise larger apertures (e.g., expanded circular apertures, also known as keyhole terminating ends), to accommodate adjustability in response to the described motion.

Figure 2A:
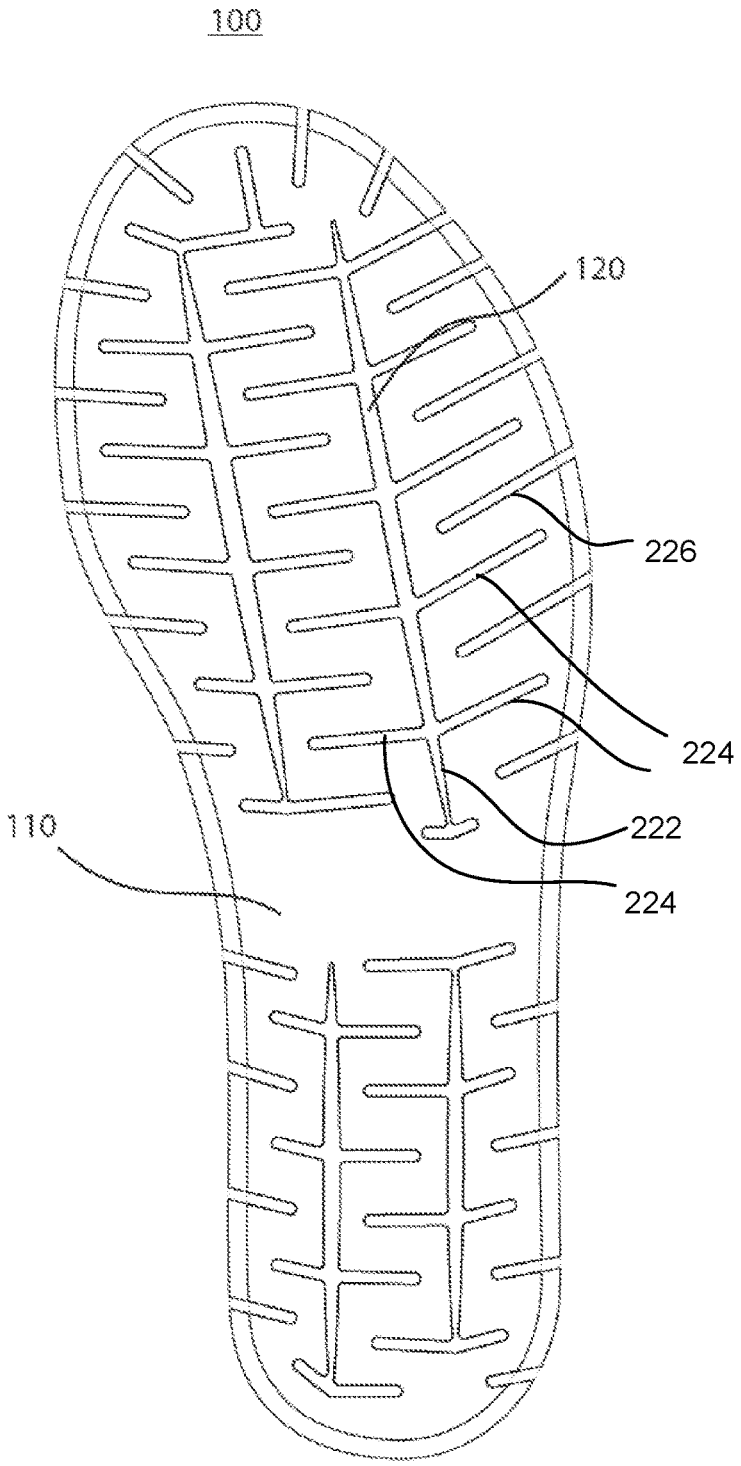
FIGS. 2A, 2B, 2C, 2D, 2E, and 2F illustrate a sole structure of adjustable footwear having various patterns of apertures, in accordance with various embodiments.
Figure 2B:
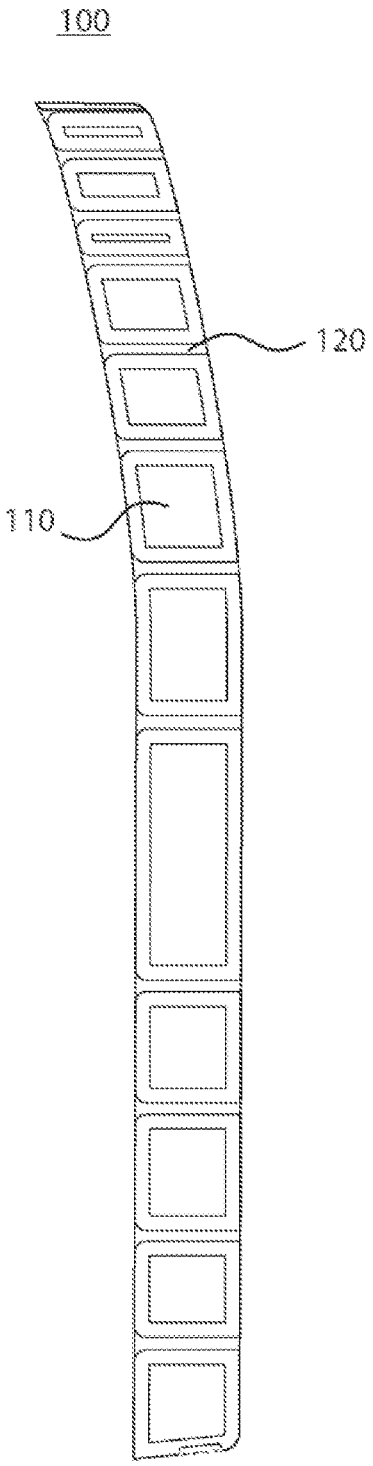

In various embodiments, and with specific reference to FIGS. 2A and 2B, the apertures 120 defined by the sole structure 110 form an array or pattern of channels. For example, the plurality of apertures may comprise a plurality of branched channel structures. A branched channel structure may include a main channel 222 with a plurality of offshoot channels 224 extending therefrom. The main channel 222, according to various embodiments, is substantially linear and may extend generally parallel to the longitudinal direction of the portion of the sole structure in which it is defined. In various embodiments, the offshoot channels 224 may extend away from the main channel 222 towards the lateral or medial sides of the show. The offshoot channels 224 may form an alternating pattern with other offshoot channels from adjacent branched channel structures/apertures and/or with edge apertures 226 that extend from an edge of the sole structure inwards.

In various embodiments, the plurality of apertures comprises one or more branched channel structures in the forward portion of the sole structure and one or more branched channel structures in the rear portion of the sole structure. For example, the sole structure may include a pair of branched channel structures in the forward portion of the sole structure, with respective main channels extending substantially parallel to each other. The sole structure may additionally or alternatively include a pair of branched channel structures in the rear portion of the sole structure, with respective main channels extending substantially parallel to each other. In various embodiments, the main channel(s) in the forward portion are not parallel with the main channel(s) in the rear portion.

In various embodiments, and with continued reference to FIGS. 2A and 2B, the apertures 120 may be predisposed in an expanded position, and thus adjustability may be achieved by selectively collapsing one or more of the apertures. In various embodiments, as described below, the shoe may include one or more belts, straps, cords, or ratcheting mechanisms configured to compress the shoe (i.e., the sole structure) into a desired shape by deforming the apertures. This locking feature, which may be referred to as a compressing feature, may be generally disposed around an edge of the sole structure (e.g., around at least a section of the perimeter of the sole structure) and may be configured to compress and retain the apertures in the adjusted shape. In various embodiments, a zipper may be configured and disposed along an edge of sole structure to facilitate adjustments.

Figure 2C:
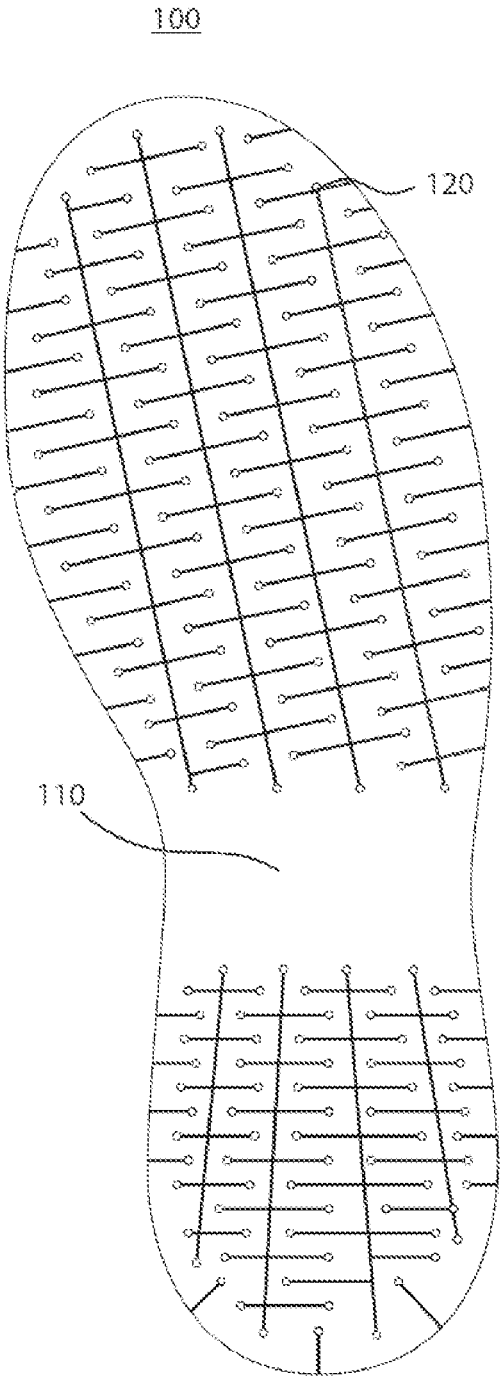
Figure 2D:
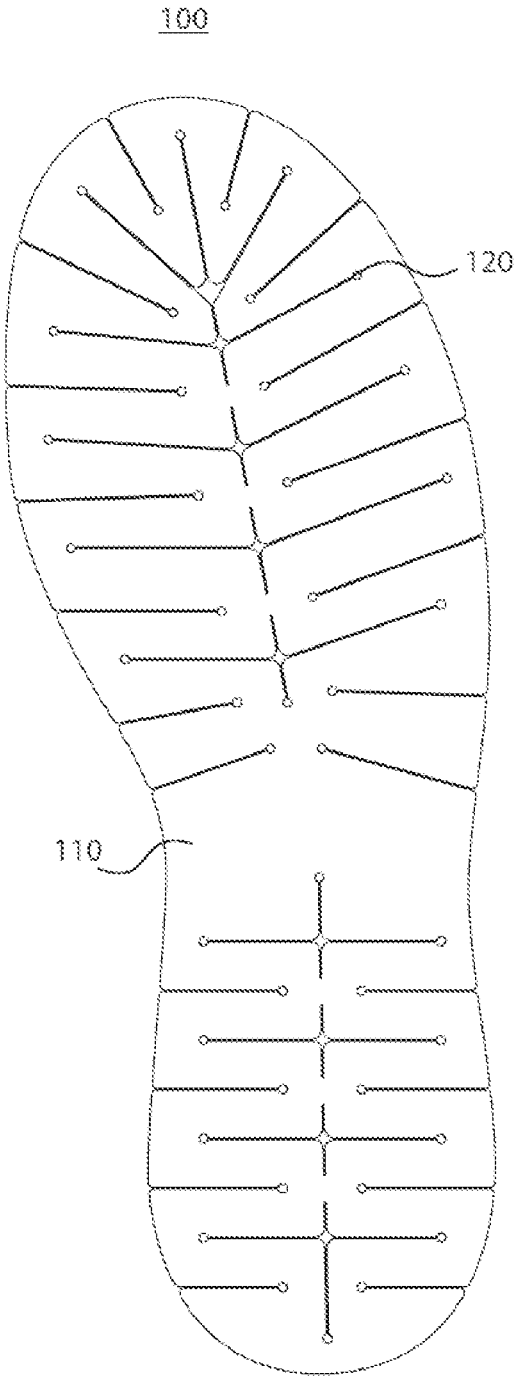

In various embodiments, and with reference to FIGS. 2C and 2D, the one or more apertures 120 may comprise channels that are substantially closed/collapsed but may be expandable to accommodate size adjustments to the sole structure 110. Similar to the branched channel structures/apertures described above, the sole structure 110 may define an array of separate channel structures, each having branches that offshoot from a main channel. In various embodiments, the main channel(s) in the forward portion may be nonparallel with the main channel(s) in the rear portion of the sole structure 110. In various embodiments, the closed end of each aperture (e.g., the end of each offshoot channel and/or the end of the main channels) has a keyhole-shaped termination.

Figure 2E:
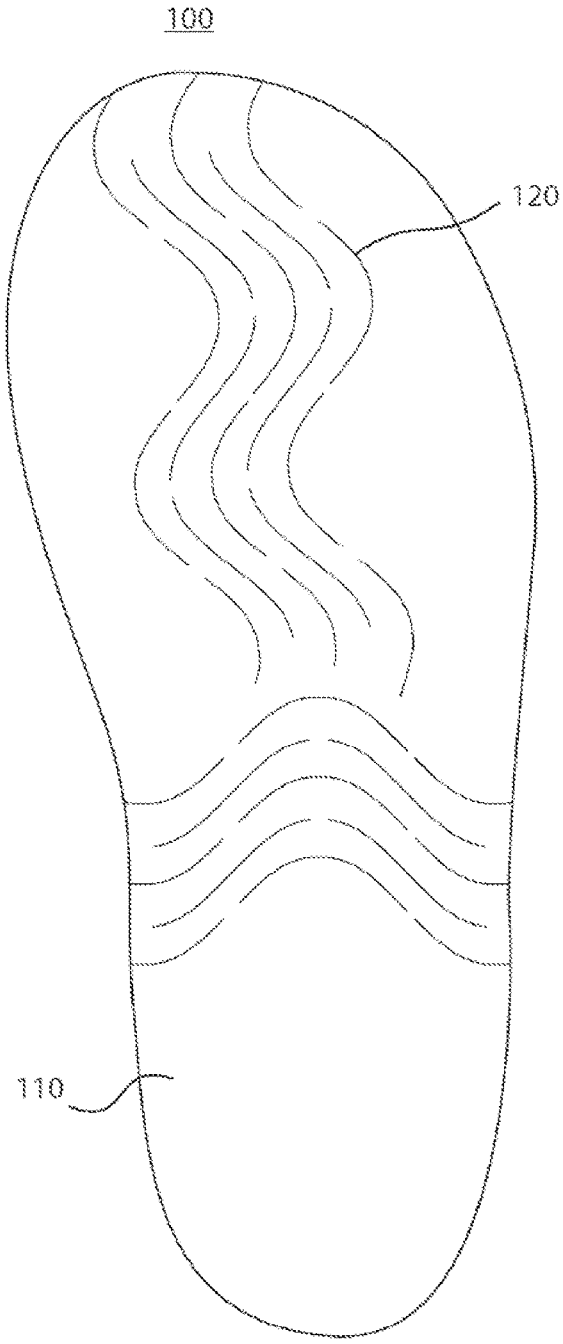

In various embodiments, and with reference to FIG. 2E, the one or more apertures 120 may comprise a wave-like, undulating pattern. For example, the sole structure 110 may include one or more apertures that extend in a wave-like pattern from a front portion of the sole structure towards the middle or rear portion of the sole structure. The sole structure 110 may include one or more apertures that extend in a wave-like pattern from a lateral side of the sole structure toward a medial side of the sole structure. In various embodiments, the wave-like channels may extend substantially parallel to each other and thus may have complementary wave-forms.

Figure 2F:
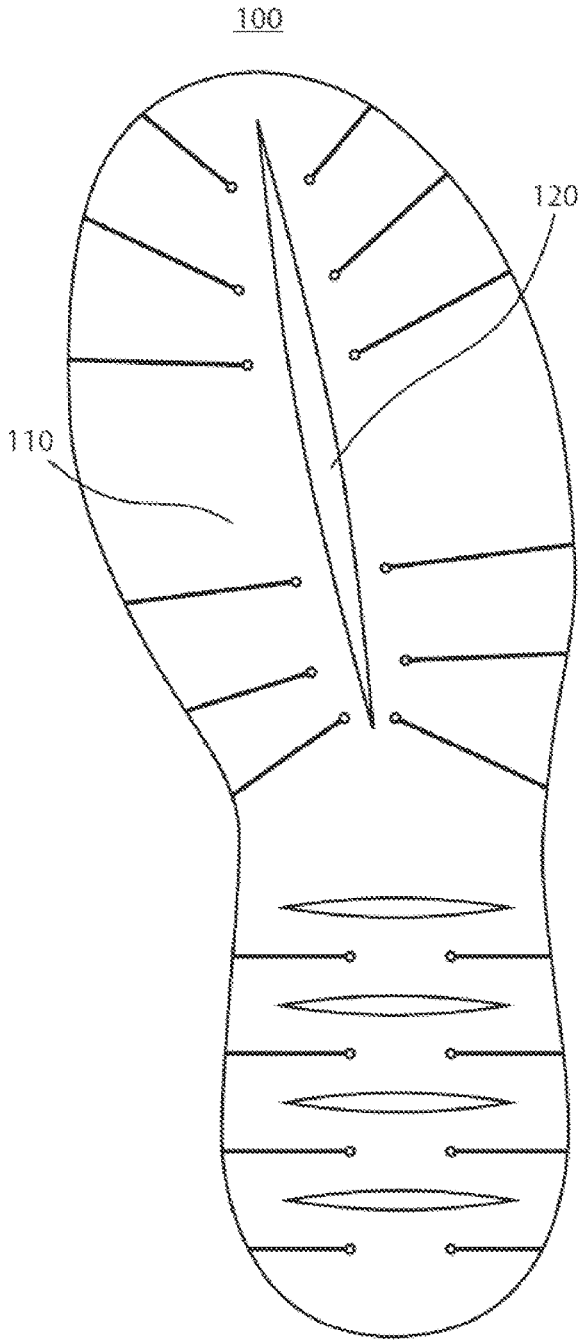

In various embodiments, and with specific reference to FIG. 2F, the apertures 120 of the sole structure 110 comprise slits. For example, the sole structure 110 may include a large central slit extending from adjacent the front/forward edge of the sole structure to about the middle of the sole structure. In various embodiments, the rear portion of the sole structure comprises a series of slits, each oriented in a transverse configuration (e.g., extending in a direction from a lateral to a medial side).

Figure 2G:
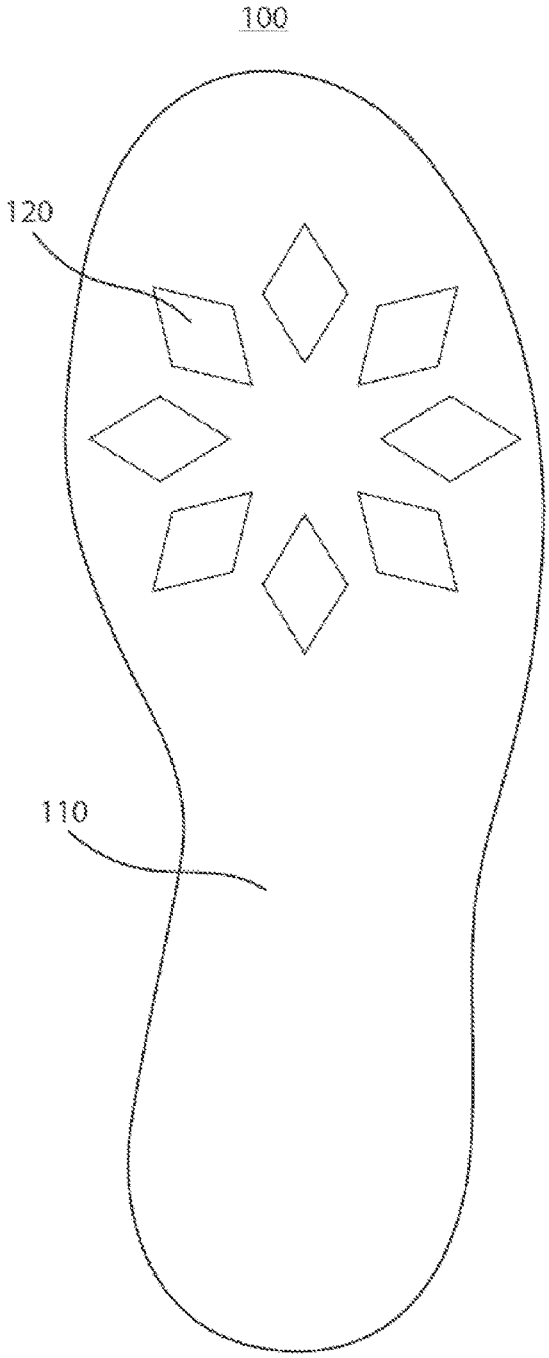
FIGS. 2G and 2H illustrate a sole structure of adjustable footwear having a Hoberman mechanism, in accordance with various embodiments.
Figure 2H:
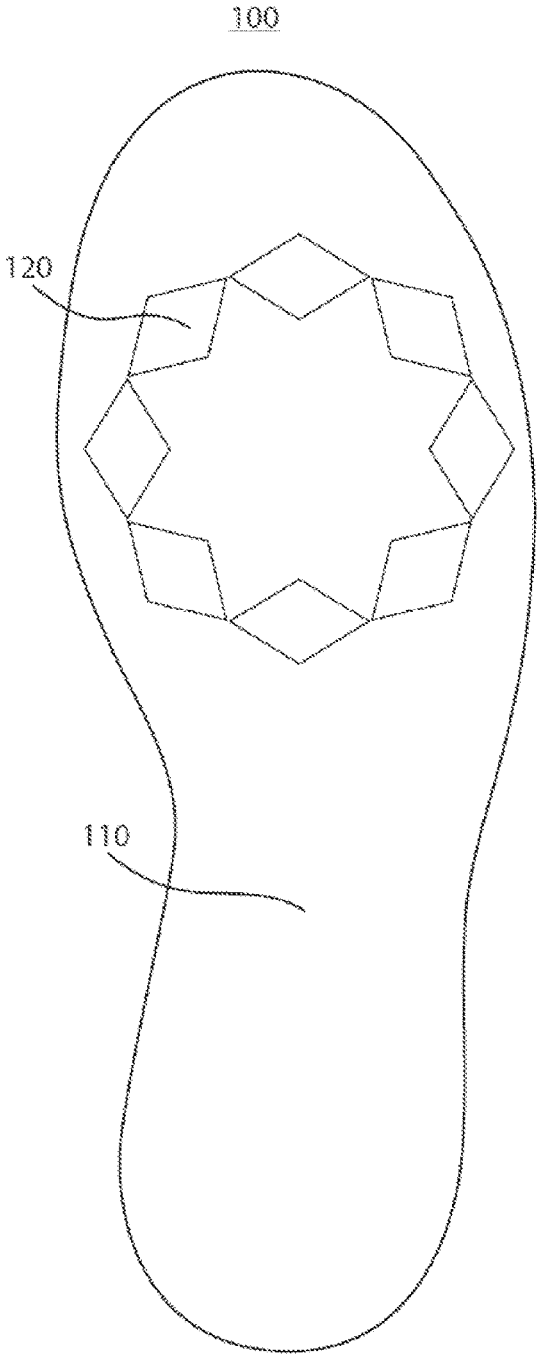
Figure 2I:
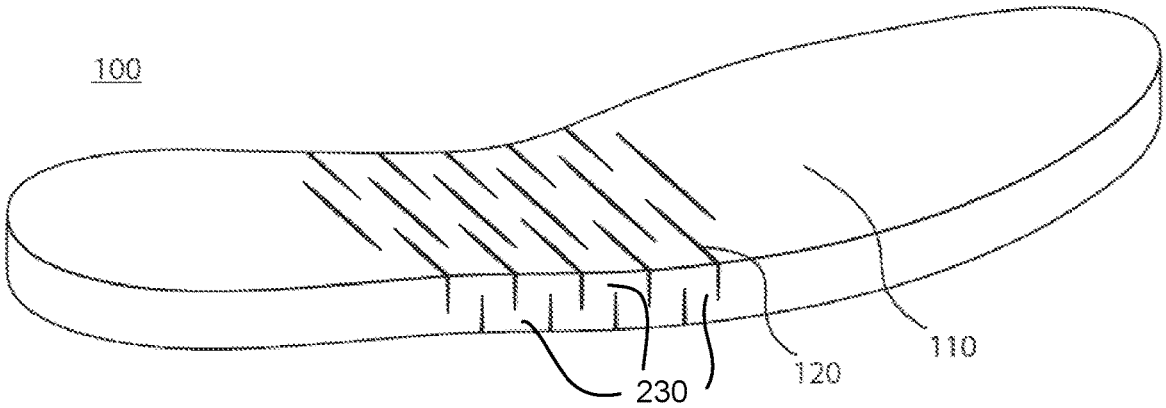

With reference to FIGS. 2G and 2H, the sole structure 110 of a shoe 100 can comprise a plurality of apertures 120 extending all or partially between the bottom surface of the sole structure 110 and the top surface of the sole structure 110, the apertures 120 combining to create a Hoberman mechanism wherein operation of each joint is linked to all the others such that circumferential actuation generates radial motion.

Figure 2J:
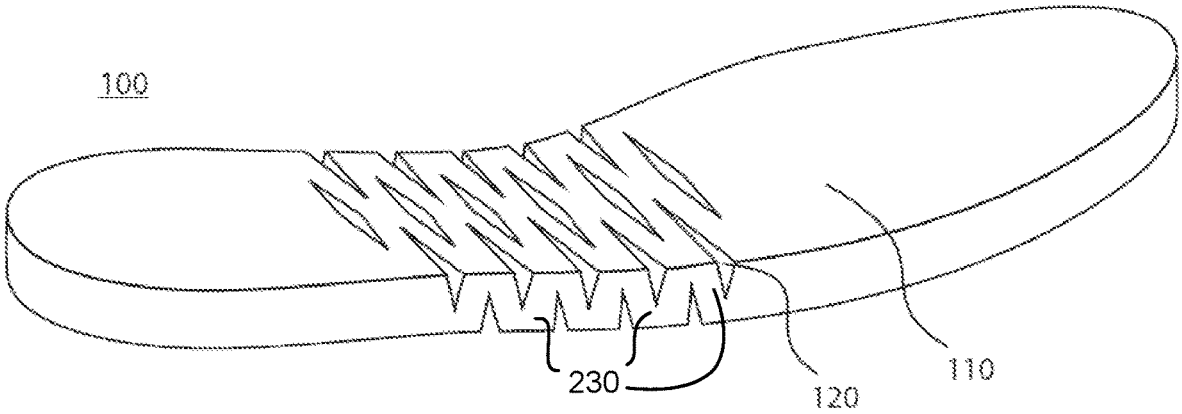

With reference to FIGS. 21 and 2J, the sole structure 110 of a shoe 100 can comprise a plurality of apertures 120 extending into both of the bottom and the top surface of the sole structure 110, for example, in an offset, complimentary fashion. Such embodiments can provide for flexing in addition to length and/or width adjustability of the shoe. In various embodiments, all of the apertures of the sole structure are not pass-through apertures and thus all the apertures may only extend partially through the sole structure from the top surface to the bottom surface. In various embodiments, the thickness of the sole material 230 extending between the offset/alternating apertures comprises a substantially uniform thickness (e.g., when viewed from the medial or lateral side of the shoe). This uniform thickness may help to prevent on area of the sole structure from experiencing a majority of the stress/strain from the adjustability movements of the sole structure, and may thus help to improve the life of the sole structure. In various embodiments, and with continued reference to FIG. 2J, the apertures may each have a triangular-shaped volume/void.

Figure 2K:
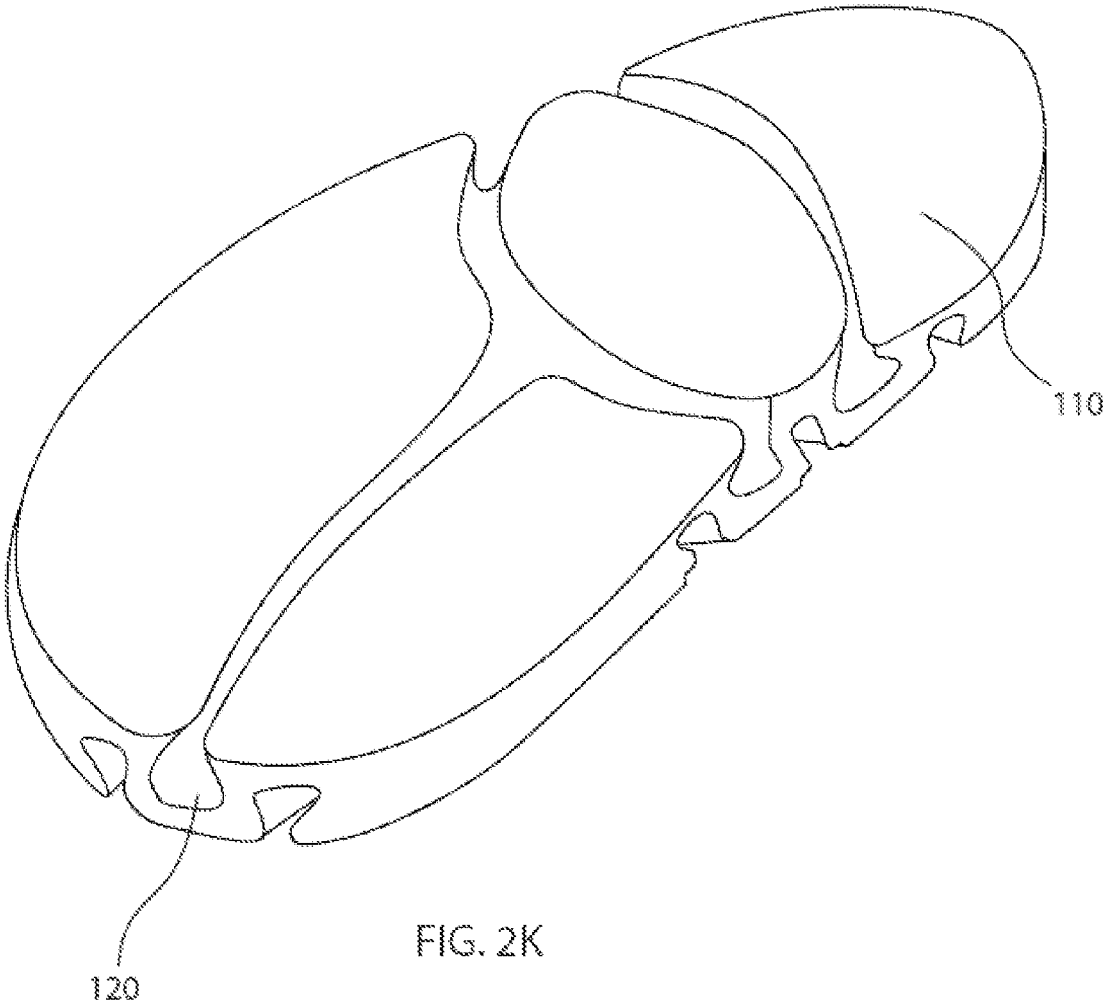
FIG. 2K illustrates a perspective view of a sole structure of adjustable footwear having various channels, in accordance with various embodiments.

With reference to FIG. 2K, the sole structure 110 of a shoe 100 can comprise one or more apertures 120 extending all or partially between the bottom surface of the sole structure 110 and the top surface of the sole structure 110, the apertures 120 extending in three dimensions. Stated differently, an aperture 120 can have a larger cross section between a bottom and a top surface of the sole structure 110 than a cross section of the aperture 120 at the bottom and/or the top surface of the sole structure 110. In various embodiments, the cross-sectional shape of the aperture is circular or bulbous, thus having the wider cross-section at the diameter of the circle/bulb.

Figure 3A:
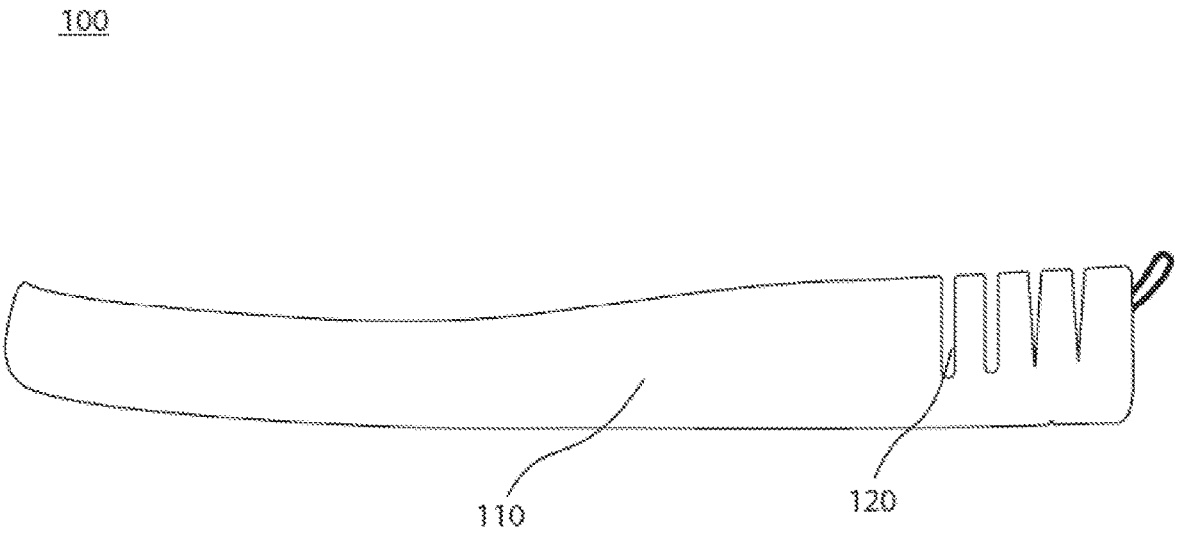
FIGS. 3A and 3B illustrate a side view of a sole structure of adjustable footwear having a slidable footbed, in accordance with various embodiments.
Figure 3B:
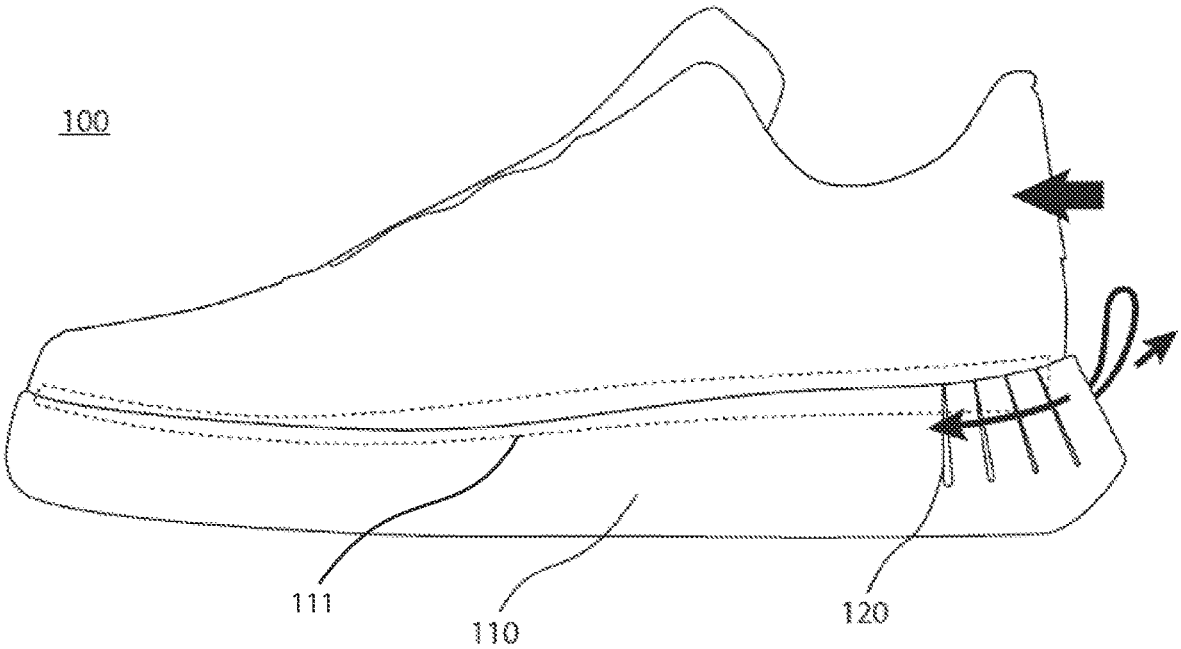

With reference to FIGS. 3A and 3B, the sole structure 110 of a shoe 100 can comprise a plurality of apertures 120 extending all or partially between a lateral side of the sole structure 110 and the other lateral side of the sole structure 110 (e.g., on a top side, in contact with an upper, as illustrated, or on a bottom side). In such example embodiments, the apertures 120 can decrease in size (e.g., in a wedge shape) from a top side of the sole structure 110 toward a bottom side of the sole structure. In such example embodiments, the shoe 100 can comprise a footbed 111 configured to be slidable from a rearward portion of the shoe 100 toward a forward portion of the shoe 100, in response to a rearward portion of the sole structure 110 being rotated upward, e.g., by a pull tab extending through the sole structure 110 to gather the apertures 120.

Figure 4A:
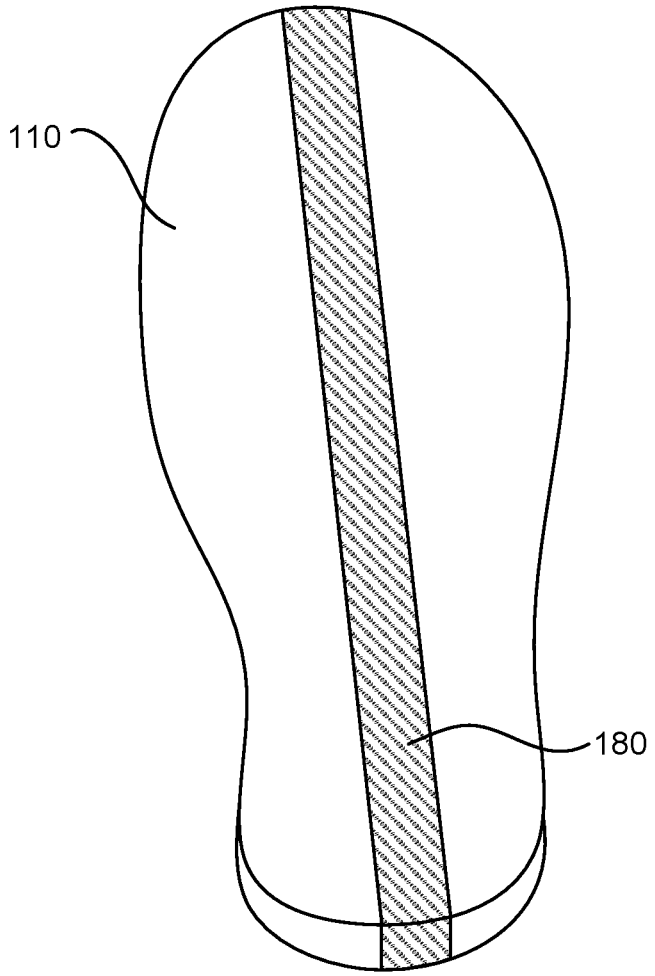
FIG. 4A illustrates a view of a sole structure having a removeable material disposed in a longitudinally extending channel of the sole structure, in accordance with various embodiments.
Figure 4B:
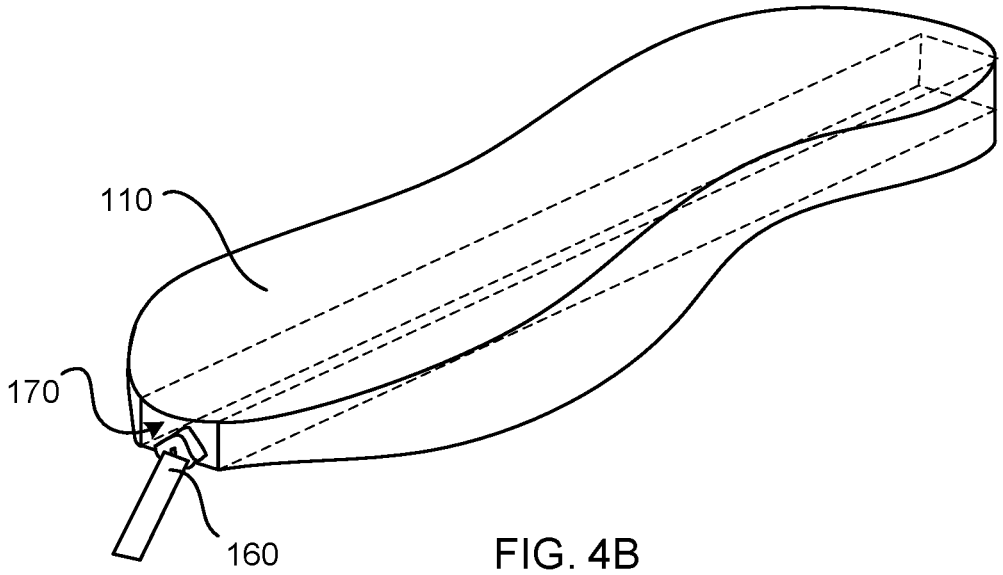
FIG. 4B illustrates a view of a sole structuring defining a longitudinally extending channel, in accordance with various embodiments.

In various embodiments, and with reference to FIGS. 4A and 4B, the sole structure 110 may define a channel 170 (e.g., a longitudinally extending channel) that allows for the dimensions of the sole structure 110 to be changed. A compressible and/or a removable material 180 may be disposed in the channel 170. In various embodiments, the material 180 may be compressed to alter the dimension of the sole structure 110, or the material 180 may be removed to decrease the dimension of the sole structure 110. In various embodiments, the sole structure 110 may include a fastening feature 160, such as a zipper or other mechanism, configured to releasably retain the material 170 within the channel 180, and/or to otherwise facilitate reversibly securing the sole structure 110 in an adjusted or adjustable state. In various embodiments, the fastening feature 160 may be at least partially housed within the channel 170.

A shoe as described herein can have an open configuration, in which one or more of the apertures 120 are all or partially open and the shoe 100 has a larger length and/or width than in a closed configuration. For example, the apertures 120 may be collapsed/compressed in order to adjust the size of the shoe.

A shoe as described herein can have a closed configuration, in which one or more of the apertures 120 are all or partially closed and the shoe 100 has a smaller length and/or width than in an open configuration. For example, the apertures 120 may be expanded in order to adjust the size of the shoe.

In some embodiments, the apertures are merely voids, while in other embodiments, the apertures are comprised of a filler material or structure, for example, a material less dense that the martial defining the apertures, an air pocket, a leaf spring, or one or a plurality of ribs (e.g., organized in a lattice structure and/or an auxetic pattern). The filler material or structure can bias, at least in part, the apertures from a closed to an open configuration, or, alternatively, from an open to a closed configuration.

In this regard, in some embodiments, the shoe is biased in an open configuration, while in other embodiments, the shoe is biased in a closed configuration. In still other embodiments, the shoe is bi-stable (i.e., in both an open configuration and a closed configuration).

In some embodiments, securement in and/or transition between, open and closed configurations, which may be incremental, is controlled by one or more of a belt, ratchet (e.g., a zip-tie mechanism), cord (e.g., extending through a sole structure out of the rear of the shoe), strap with hook and loop fasteners, or the like, in some embodiments with a quick release, surrounding all or a portion of the sole structure. For example, a strap can be belted through apertures in a perimeter of a sole structure. In other embodiments, securement in and/or transition between, open and closed configurations, is controlled by an air bladder. In still other embodiments, securement in and/or transition between, open and closed configurations, is controlled by a screw, cord or the like extending through one or more apertures, which may further be driven by a cam system, e.g., including an eccentric wheel. In yet other embodiments, securement in and/or transition between, open and closed configurations, is controlled by an eccentric wedge element positioned in one or more apertures that, when turned, transitions the aperture(s) from a closed to an open configuration, or, alternatively, from an open to a closed configuration. Moreover, a shoe in accordance with the present disclosure may comprise one or more visual, tactile or audible indicators of adjustment (e.g., a click every 2 mm or a mark corresponding to 2 mm). In connection with example embodiments, the sole structure may have a surrounding bumper surrounding all of a portion of the sole structure, the bumper having one or more folds, pleats or baffles, or overlapping or telescoping portions, to accommodate length and/or width adjustability of the shoe.

In various embodiments, the footbed of the shoe may be configured as a lock/locking strip that facilitates the adjustability accommodation. For example, engagement between footbed and the apertures of the sole structure may cause the sole structure to be locked/retained in place once the size adjustments have been effectuated. In various embodiments, the footbed comprises protrusions that extend into sole structure (e.g., into the apertures) to expand the sole structure. For example, the sole structure may be naturally compressed and insertions of the protrusions/spears may cause expansion of the sole structure. In various embodiments, the footbed may be swapped out to achieve a different sizing of the shoe (e.g., by causing different apertures to expand). Said differently, the adjustability of the shoe may correspond with a replaceable footbed, and thus users may change the footbed in order to change the desired size/shape of the sole structure.

To accommodate adjustment to length and/or width of the sole structure, an upper coupled to the sole structure may be comprised of an expandable material (e.g., a knit, stretch or elastic material), comprise one or more gussets or gores, and/or comprise overlapping or folding panels. Additionally, coupling of an upper to the sole structure may not be at the apertures (regardless of whether comprising a filler material or structure as described herein). For example, an adhesive may be selectively applied (e.g., screen printed) to the sole structure only around the apertures (i.e., not covering the apertures). Additionally, a footbed of a shoe in accordance with the present disclosure may comprise one or more features to accommodate length and/or width adjustability of the shoe, for example, one or more expandable/collapsible apertures, gussets, gores, overlapping or folding panels, or the like. Additionally, the sole structure may be covered with a hardened material to provide protection from objects extending through the apertures and/or to provide comfort relative to the apertures.

It will be apparent to those skilled in the art that various modifications and variations can be made in the present disclosure without departing from the spirit or scope of the disclosure. Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

We claim:

1. A sole structure for adjustable footwear, the sole structure comprising:

at least one aperture, wherein the at least one aperture decreases in size from a top side of the sole structure toward a bottom side of the sole structure to form a wedge shape, and wherein the at least one aperture is configured to facilitate adjustability of at least one of a size and a shape of the sole structure; and a footbed slidable from a rearward portion of the sole structure toward a forward portion of the sole structure in response to the rearward portion of the sole structure being rotated upward by actuation of a pull tab extending at least partially through the sole structure to gather the at least one aperture.

2. The sole structure of claim 1, wherein the at least one aperture only extends partially through the sole structure.

3. The sole structure of claim 1, wherein the at least one aperture is a plurality of apertures.

4. The sole structure of claim 1, wherein the at least one aperture is predisposed in an expanded position such that adjustability is achieved by selectively collapsing the at least one aperture.

5. The sole structure of claim 4, further comprising a compressing feature configured to retain the at least one aperture in a collapsed position.

* * * * *